US005626153A

United States Patent [19]

Petrarca

[11] Patent Number: 5,626,153

[45] Date of Patent: May 6, 1997

[54] SPECIAL APPLICATION COMB

[76] Inventor: Edward Petrarca, 154 Phenix Ave., West Warwick, R.I. 02893

[21] Appl. No.: 409,601

[22] Filed: Mar. 24, 1995

[51] Int. Cl.[6] ..... A45D 24/04

[52] U.S. Cl. ..... 132/126; 132/150; 132/144; 132/149; 132/270

[58] Field of Search ..... 132/150, 160, 132/208, 116, 151, 139, 125, 126, 136, 137, 144, 142, 213.1, 270, 207

[56] References Cited

U.S. PATENT DOCUMENTS

| | | | |
|---|---|---|---|
| 2,551,330 | 5/1951 | McEleney | 132/144 |
| 2,785,688 | 3/1957 | Chester | 132/139 |
| 3,192,934 | 7/1965 | Catania | 132/150 |
| 3,368,569 | 2/1968 | Lawrence | 132/139 |
| 5,275,182 | 1/1994 | Northcutt | 132/144 |

*Primary Examiner*—Gene Mancene
*Assistant Examiner*—Pedro Philogene
*Attorney, Agent, or Firm*—Robert J. Doherty

[57] ABSTRACT

A hair separating comb in which a plurality of major parallel teeth are provided so as to form a series of parallel major grooves in which hair strands by comb action engage and additionally where a longitudinally movable separation shaft moves between and a rest and an operable position to trap and separate hair strands within such grooves from those in other positions within the comb.

9 Claims, 6 Drawing Sheets

SPECIAL APPLICATION COMB

BACKGROUND AND OBJECTS OF THE INVENTION

This invention relates to a special purpose comb and more particularly to a comb of the type which can separate groups or strands of hair upon the human head such that the separated strand groups may be highlighted, streaked or frosted with special solutions such as bleach, dye and the like. While conventional combs can be utilized to separate hair strands into separate groups, it is time consuming and thus requires extra effort by the hairdresser and no provision with such conventional combs is made to assist in holding the thus separated strands in the thus separated or isolated condition except by actually holding them. Inasmuch as the hairdresser is already busy manipulating shields, foils and the like utilized in the application of bleach or-other coloring material to the separated hair, it would be an advantage to provide a specialized comb structure which not only separates the hair strands into groups but provides means by which they can at least e temporarily held in such position.

The present applicant is aware of the presence of literature describing some specialty comb structures, namely, those shown in U.S. Pat. No. 5,231,999 issued Aug. 3, 1993 and U. S. Pat. No. 2,915,071 issued Dec. 1, 1959. An additional comb structure specifically utilized to control the amount of bleach or frosting applied to hair with a comb is a structure shown in U.S. Pat. No. 3,818,917 issued Jun. 25, 1974. The first above-mentioned patents utilize fixed positioned barbed teeth to trap hair strands as they move between such teeth underneath the barbs thereof and then by appropriate twisting or other comb manipulation enables strand separation. Thus such described devices would require a twisting manipulation of the comb where such may not be desirable and further may not always hold the separated hair strands from upward movement once separated.

Accordingly, it remains a desirable feature of such combs to more positively restrain the separated hair strands from upward movement and one in which no unusual manipulative movements to the comb is necessary in order to achieve hair strand separation.

An additional desirable feature and object of the present invention is to accomplish the above objectives while utilizing a comb of normal physical characteristics and which is easy to use and of relatively low cost and sturdy construction.

These and other objects of the present invention are accomplished by a comb for separating strands of hair to implement and facilitate highlighting, streaking or frosting, comprising an elongated body with a handle at one end and a plurality of longitudinally separated major teeth outwardly projecting from the body at the other end thereof, said major teeth being separated by major grooves in turn each having an outer open end and a closed base portion vertically separated from said open end for receipt of hair strands therein, said body further having hair strand separating means mounted for longitudinal movement with respect to said body and said major grooves from a first non-operating position to a second operating position wherein said hair separating means spans one or more of said major grooves at a point removed from the base thereof wherein some hair strands positioned in said major grooves are in turn further separated by said separating means.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DETAILED DESCRIPTION OF THE INVENTION

Figure 1:
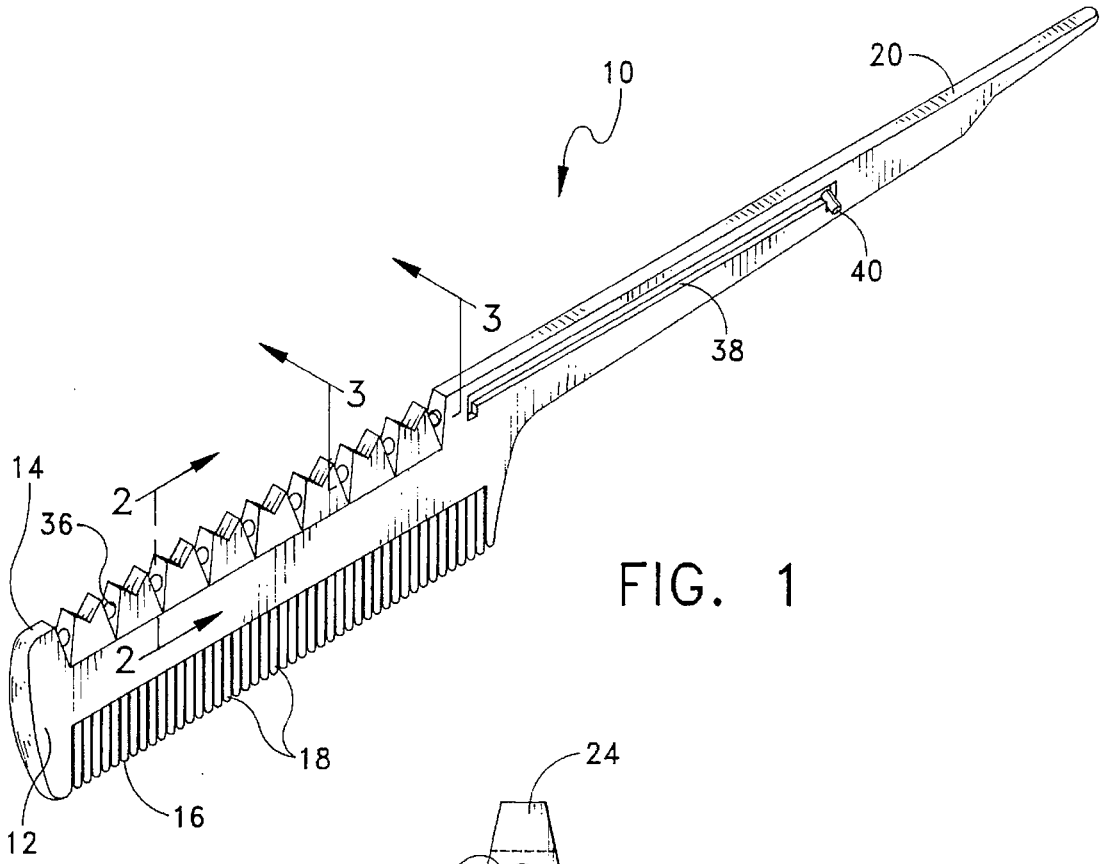
FIG. 1 is a front perspective view of a comb showing one embodiment thereof.

Turning now to the drawings and more particularly to FIGS. 1 through 6 thereof, the comb 10 depicted therein includes an elongated body 12 having opposed upper and lower surfaces 14 and 16 respectively. The lower surface 16 may include parallel conventional or minor comb teeth 18 while the upper surface 14 includes the means by which the comb is able to facilitate strand separation in accordance with this invention. It, of course, should be brought out that the strand separation means could be alternatively placed on the lower surface 16 and the conventional comb teeth 18 positioned on the upper surface 14. An elongated handle 20 extends rearwardly from the body 12 and generally in line with and forming an extension of the body 12.

Figure 2:
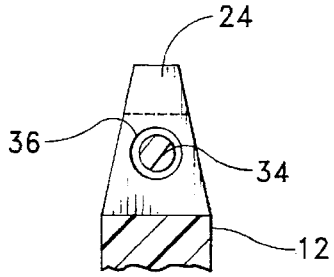
FIG. 2 is a sectional view along the lines 2—2 of FIG. 1.
Figure 3:
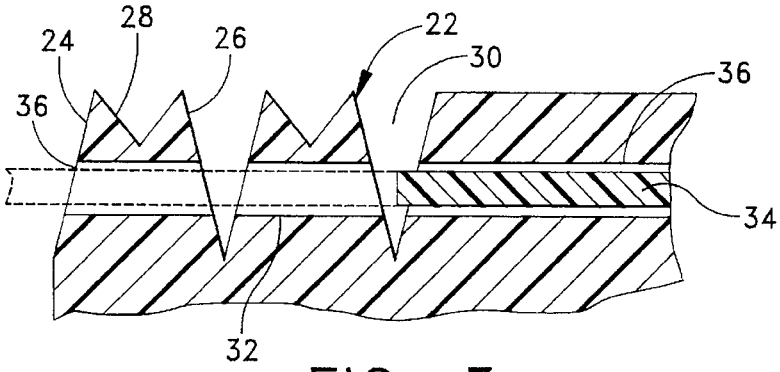
FIG. 3 is a side sectional view along the lines 3—3 of FIG. 1.

As perhaps best shown in FIGS. 1 through 3, the upper surface 14 is provided with a plurality of in line longitudinally spaced major teeth 22 which extend upwardly from the body 12. Preferably, the teeth are upwardly and inwardly slanted, that is, they each include a pair of upwardly tapered surfaces, including a leading or forward surface 24 and a trailing or rear surface 26. In addition, the top surface of each major tooth 22 is preferably provided with a laterally extending minor groove 28.

Between each of the major teeth 22, a major groove 30 is disposed. Such grooves downwardly inwardly extend into the comb body 12 and are defined by the opposed leading and trailing tooth surfaces 24 and 26. It should be pointed out that when the tooth surfaces are slanted as depicted, the major grooves 30 will be V or generally U-shaped similar to the minor grooves 28 but that such surfaces 24 and 26 may be more relatively straight if desired. However, the slanted walls 24 and 26 which make up the shape of the major grooves 30 and the walls which make up the surface of the minor grooves 28 when generally V-shaped contribute to the movement of hair strand groups downwardly inwardly thereinto and to some extent facilitate much desired movement of the hair strands with respect to the comb.

Each of the major teeth 22 is provided with a bore 32 such that the bores 32 of each major tooth 22 are aligned and may receive a shaft 34 positioned primarily with the handle 20 in its rest position and adapted to move forwardly from such rest or initial position through the plurality of bores 32 into a second or hair separation or operating position. For such purpose, a bore 36 which is, in effect, a continuation of the bores 32 and aligned therewith is positioned within the handle 20 as is an open longitudinally extending slot 38 open to one side of the handle 20. An actuator lever, handle or other means 40 by which the rod 34 can be manipulated by the user's thumb or finger is provided at a rear portion of the shaft 34 such that forward or movement to the left as shown by the arrow direction in FIG. 5 forces the shaft from its non-operating position through the bores 32 such that hair strands are trapped beneath the shaft 34 and the base or root portions of the major grooves 30. In such position they are held from upward movement and thus facilitate the more positive separation of those strands caught in such position. The strands may thus may be held there until it is convenient for the operator to manually grasp them for further manipulation and the application of treatment solutions thereon.

Figure 4:
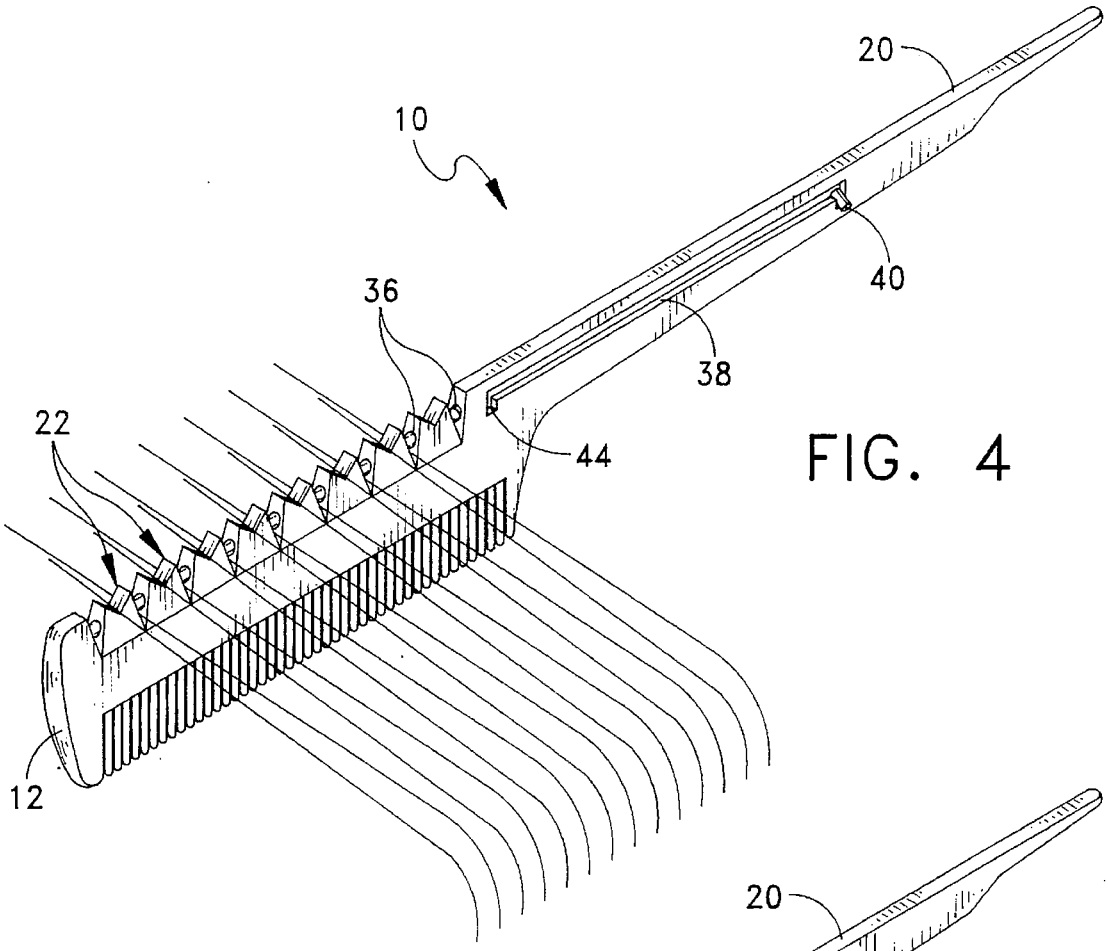
FIG. 4 is a view similar to FIG. 1 but showing hair strands entering the major grooves of the comb.
Figure 5:
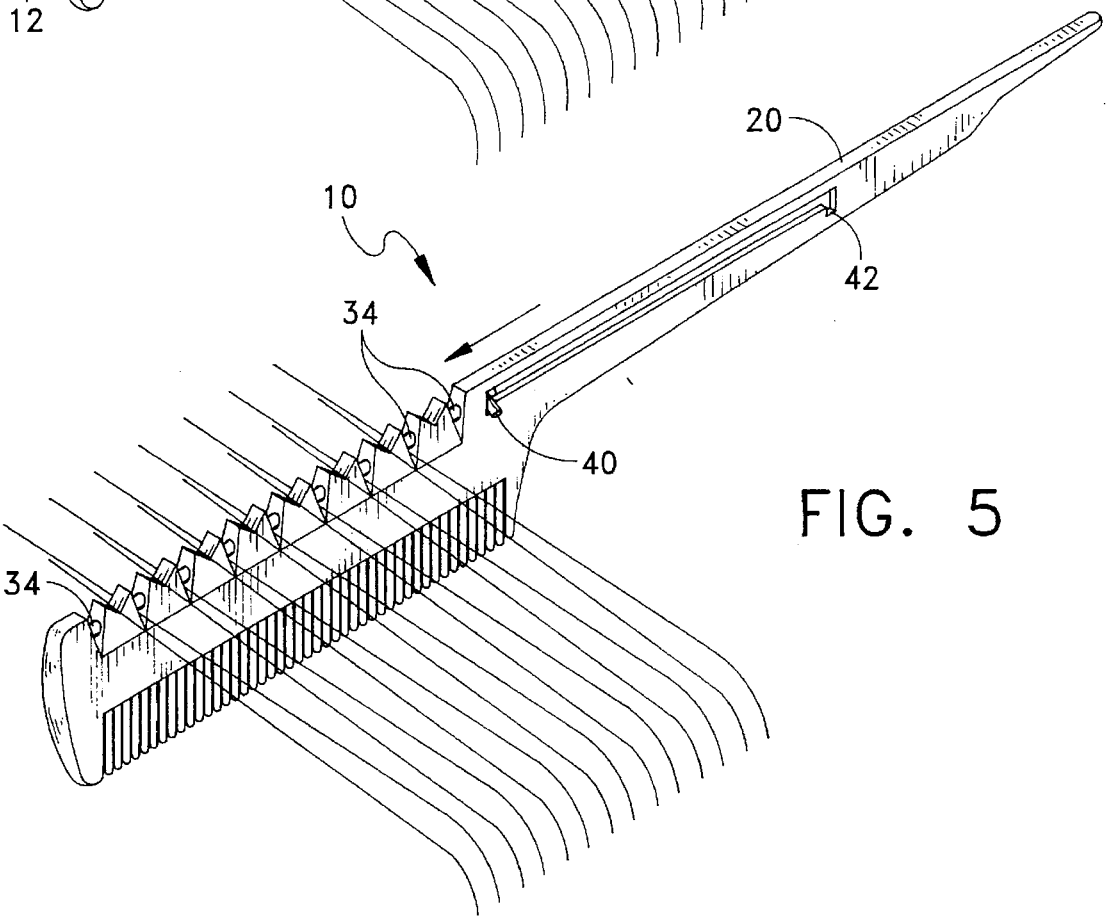
FIG. 5 is a view similar to FIG. 4 but showing the hair strand separating means moved in the direction of the arrow shown on the handle thereof to its operable position.
Figure 6:
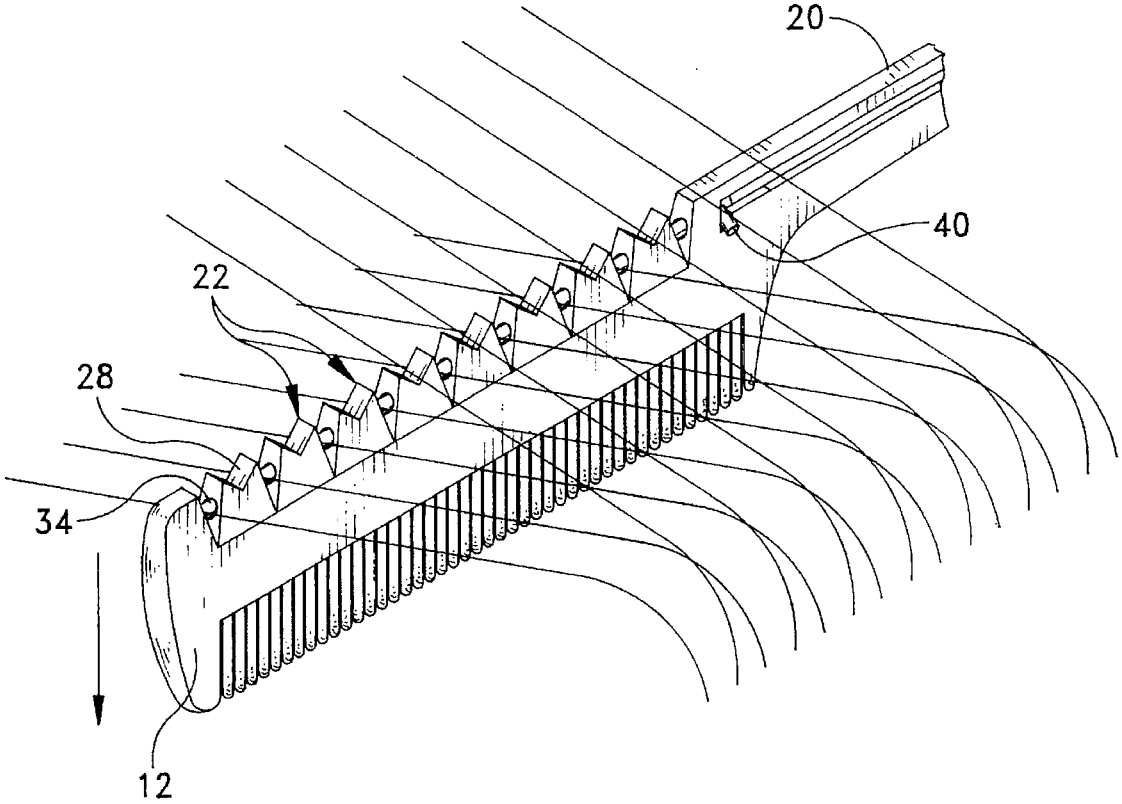
FIG. 6 is a view similar to FIG. 5 but showing the comb moved in a downward position therefrom whereby hair strands are caught beneath separating means and thus separated from the remaining strands.
Figure 7:
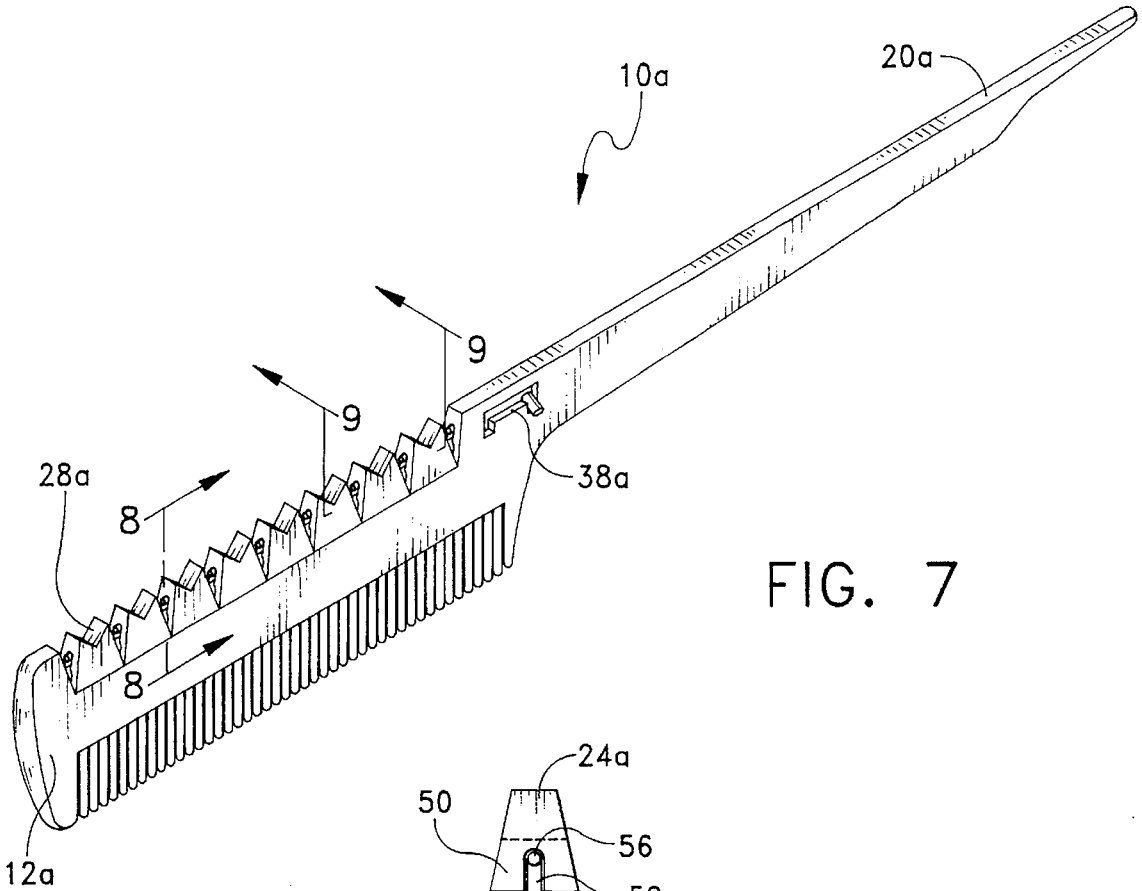
FIG. 7 is front perspective view similar to FIG. 1 but showing a modified embodiment of the invention.
Figure 8:
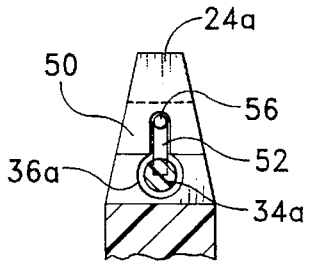
FIG. 8 is a sectional view along the lines 8—8 of FIG. 7.

In addition, the slot 38 may include downwardly extending terminal locking notches 42 and 44 at the rear and forward terminal ends thereof such that the pin or other detent means 40 may be respectively positioned therein in its rest and actuated positions as shown in the transition between FIGS. 4 and 5. Also shown in such Figures is the manner in which hair strands may be caught in the minor grooves 28 such that an initial rough hair strand separation is accomplished merely by passing the upper end of the comb through the hair, that is, a rough separation wherein some of the hair strands rest in the minor grooves 28 and some of the hair strands rest in the major grooves 30. Thereafter by further comb manipulation, for instance, in an upward direction, most if not all of the strands initially moving into the major grooves 30 will be forced into the base portion of the groove and trapped beneath the shaft 34 as it slides into its second position although depending upon manipulation, some may still extend above the shaft and thus not be trapped. It is also not necessary that the shaft move its full extent to the left as shown in the drawings but should it move less than such full extent, hair strands will only be separated as intended in those major grooves 30 in which the shaft does extend.

Turning now to the further embodiment of the invention shown in FIGS. 7 through 12, the comb structure 10*a* depicted therein essentially includes the same body and handle configurations as in the previous embodiment. The key difference being the movement of shaft 34*a* is essentially limited to that of the lateral extent of a major groove 30*a*. The slot 38*a* is also appropriately foreshortened such that the rather extensive longitudinal movement between the rest and actuating comb positions is greatly diminished in this alternate embodiment. This modification is thus helpful in the ease by which the comb 10*a* is manipulated by the operator. In addition to the shorter throw of the shaft 34*a*, each of the forward surfaces 24*a* of the major grooves 30*a* is provided with a inwardly rearwardly extending pocket 50 for receipt of a forwardly extending generally L-shaped hook 52 attached to the shaft 34*a*. Also in addition to the shaft 34*a* being positioned within the bores 32*a* and 36*a* in both the operable and non-operable positions of the comb 10*a*, the shaft 34*a* is positioned with respect to the major grooves 30*a* so that its upper surface, in effect, forms the base-or lower portion of the grooves 30*a*, that is, all other dimensions being equal the shaft is positioned at a lower point within the body 12*a*, so that hair strands are not caught beneath the movement of the shaft 34*a*.

Figure 9:
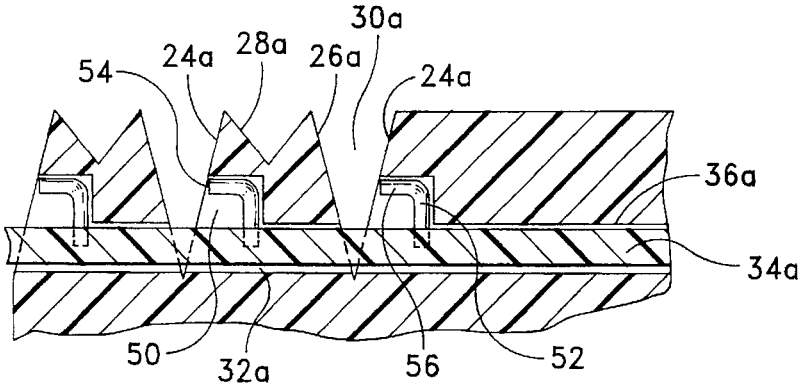
FIG. 9 is a side sectional view along the lines 9—9 of FIG. 7.
Figure 10:
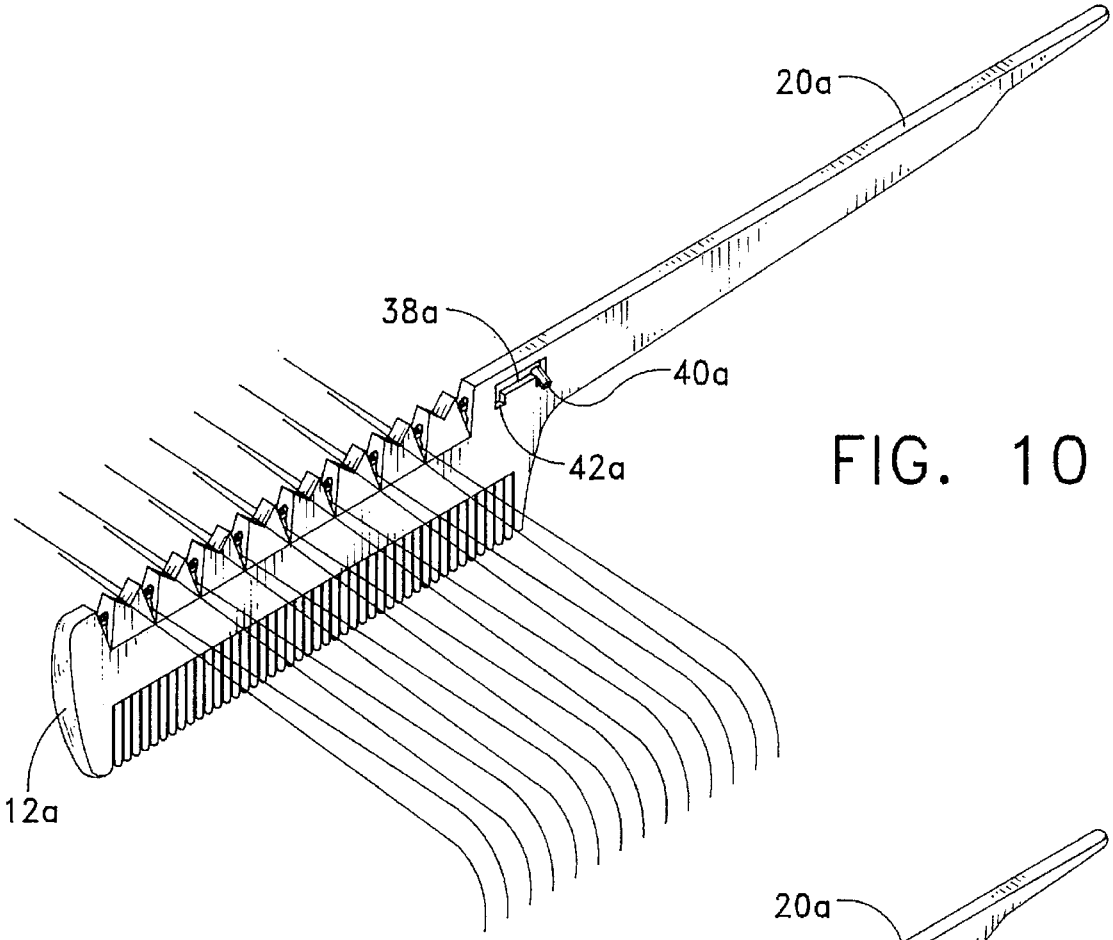
FIG. 10 is a view similar to FIG. 7 but showing hair strands entering the major grooves of the comb.
Figure 11:
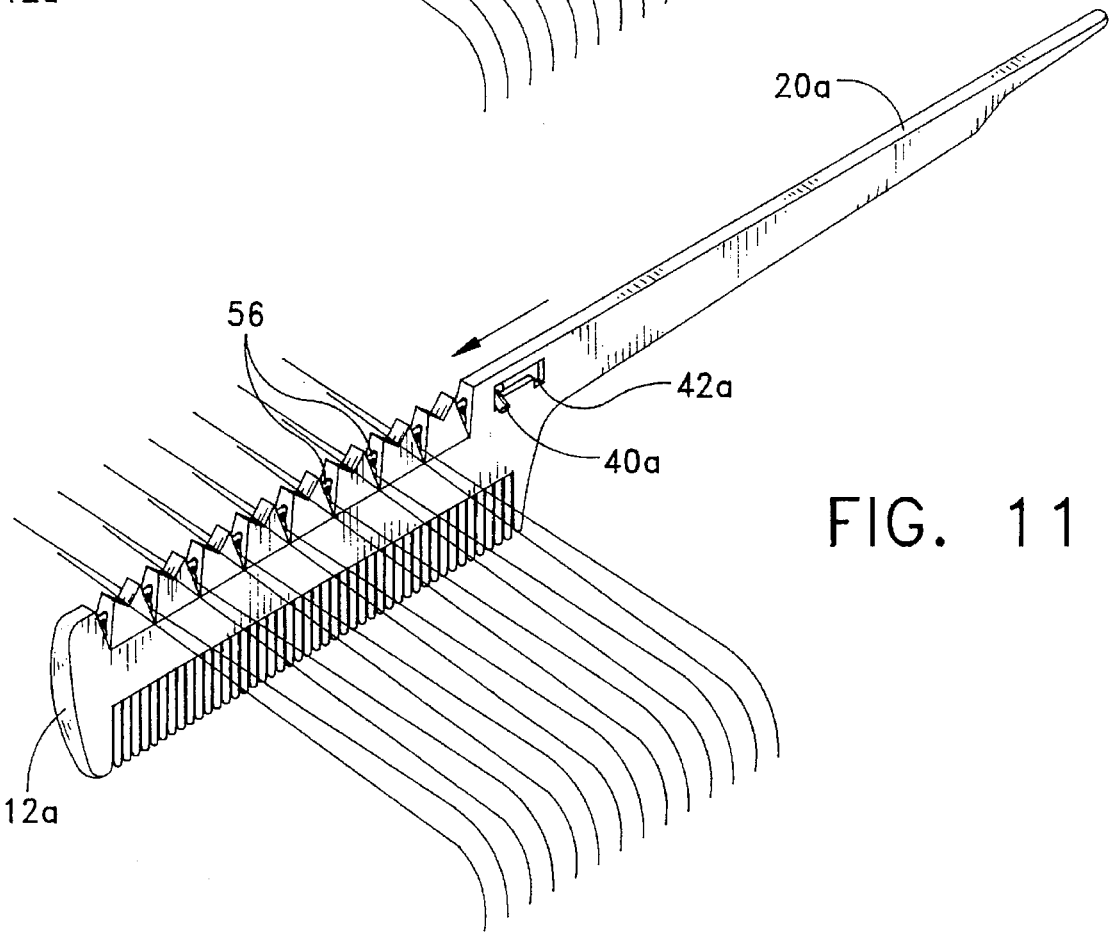
FIG. 11 is a view similar to FIG. 10 but showing the hair strand separating means moved in the direction of the arrow shown on the handle thereof to its operable position.
Figure 12:
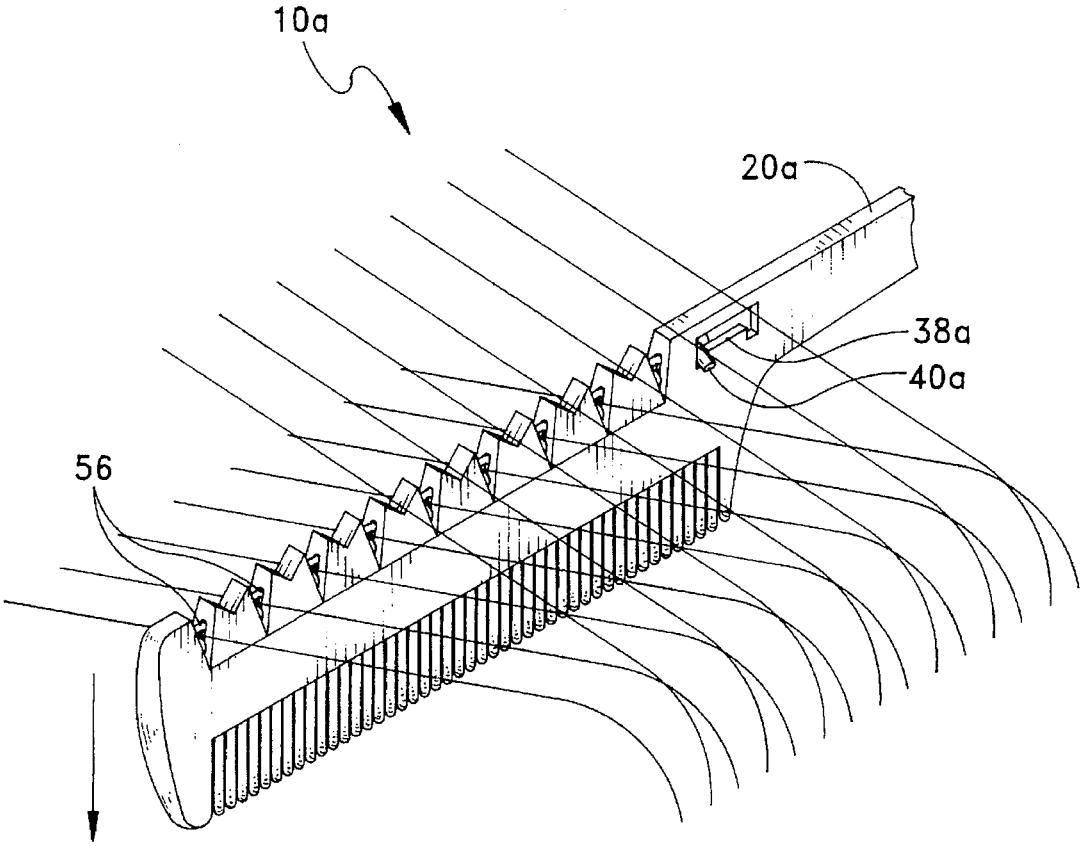
FIG. 12 is a view similar to FIG. 7 but showing the comb moved in a downward position therefrom whereby hair strands are caught beneath separating means and thus separated from the remaining strands.

It should be pointed out that in the rest position shown in FIG. 9, the hooks 52 are positioned within the pockets 50 and out of contact with hair strands but when moved to the left as shown in the transition between FIGS. 10 and 11, the shaft 34*a* moves a short distance to the left such that the forward edge 54 of each hook 52 towards or in engagement with the respective trailing surface 26 of the major teeth 22*a* and thus hair strands positioned beneath the upper portion 56 of the hook 52 and above the shaft 34*a* are trapped in the space formed therebetween and thus held for separation from the other hair strands whether they contact the minor grooves 28*a* or are disposed in the upper portions of the major grooves 30*a*, that is, above the upper portion 56 of the hooks 52.

It should also b pointed out that in some cases it may be desirable that instead of providing a comb 10 or 10*a* in which the standard teeth 18 are provided on the lower surface that such teeth are simply omitted and the comb thus provided with special hair strand separation utility only.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A comb for separating strands of hair to implement and facilitate highlighting, streaking or frosting, comprising an elongated body with a handle at one end and a plurality of longitudinally separated major teeth outwardly projecting from the body at the other end thereof, said major teeth being separated by major grooves in turn each having an outer open end and a closed base portion vertically separated from said open end for receipt of hair strands therein, said body further having hair strand separating means mounted for longitudinal movement with respect to said body and said major grooves from a first non-operating position to a second operating position wherein said hair separating means spans at least one of said major grooves at a point removed from the base thereof wherein some hair strands positioned in said major grooves are in turn further separated by said separating means, and wherein said major teeth are disposed in line with each other wherein said hair separating means includes a longitudinally slidable shaft, said shaft disposed in said handle in said non-operating position and slidable through said body in said operable position, said major teeth each having an aligned longitudinal bore for receipt of said shaft.

2. The comb of claim 1 wherein the some further separated hair strands are disposed between said shaft and the base of each said groove.

3. The comb of claim 1, wherein actuation means in the form of a slide is positioned on said handle within a longitudinal open slot provided in said handle, said slide movable between said first and said second positions a distance equal to the movement of said shaft.

4. The comb of claim 3 wherein the maximum operable shaft movement is equal to the longitudinal extent of the series of the major grooves.

5. The comb of claim 3 wherein the operable shaft movement is equal to the longitudinal extent of one of said major grooves.

6. The comb of claim 5 wherein said shaft includes a series of outwardly and forwardly extending hooks disposed within pockets in turn provided in the downstream sides of the major teeth in the first non-operating position and further disposed within said major grooves in the second operating position of the shaft wherein the some further separated hair strands are engaged by said hooks.

7. The comb of claim 6, the some further separated hair strands being disposed between said hooks and said shaft.

8. The comb of claim 1, said body having opposed upper and lower surfaces with said major teeth disposed and upwardly extending on said upper surface and a plurality of minor teeth disposed on and downwardly extending from said lower surface.

9. The comb of claim 1, said major teeth terminating in an upper surface including downwardly extending minor groove.

* * * * *